United States Patent [19]

Sokol

[11] Patent Number: 4,689,604

[45] Date of Patent: Aug. 25, 1987

[54] MOVING VISUAL DISPLAY APPARATUS

[75] Inventor: Edward F. Sokol, Milwaukee, Wis.

[73] Assignee: S-V Development Ltd., Milwaukee, Wis.

[21] Appl. No.: 471,665

[22] Filed: Mar. 3, 1983

[51] Int. Cl.[4] ..... G09G 3/00

[52] U.S. Cl. ..... 340/755; 340/792; 340/701

[58] Field of Search ..... 340/755, 792, 701, 703

[56] References Cited

U.S. PATENT DOCUMENTS

| | | | |
|---|---|---|---|
| 737,359 | 8/1903 | Currah et al. | 340/755 |
| 3,097,261 | 7/1963 | Schipper et al. | 340/755 |
| 4,160,973 | 7/1979 | Berlin, Jr. | 340/755 |
| 4,162,493 | 7/1979 | Ross et al. | 340/755 |
| 4,225,862 | 9/1980 | Johnson | 340/755 |
| 4,298,868 | 11/1981 | Spurgeon | 340/755 |
| 4,311,999 | 1/1982 | Upton et al. | 340/755 |
| 4,470,044 | 9/1984 | Bell | 340/755 |

FOREIGN PATENT DOCUMENTS

| | | | |
|---|---|---|---|
| 0156544 | 10/1985 | European Pat. Off. | 340/755 |

OTHER PUBLICATIONS

Official Gazette; 9/4/84, Notice re: Bell: U.S. Pat. No. 4,477,044.

*Primary Examiner*—Marshall M. Curtis

*Attorney, Agent, or Firm*—Andrus, Sceales, Starke & Sawall

[57] ABSTRACT

A visual display apparatus for generating an apparent visual message includes an annular drum which is rapidly rotated. Three columnar light banks are secured to drum face and each include a plurality of lights. A microprocessor and power unit is mounted to and rotates with the drums and activates the lights to generate a message or character on the drum which defines one message display frame. The microprocessor includes a program for each of the light banks for individually energizing the lights. The program includes a message program and a fixed program for processing of the message data. The message scrolls across the drum in the direction opposite the drum rotation, and the total message may consist of a plurality of frames. Each display frame covers less than the drum periphery and includes a start column and a spaced end column. A position sensor initiates the processor and generates a train of timing signals, one for each drum travel display column. During each revolution the processor sequences and operates the light banks with the alignment thereof with each display column. The light banks are spaced two message columns and the processor sequentially monitors the start column and end column of each frame to restrict activation of the light banks to those within the frame and therebetween enables all three banks to produce the desired color message presentation.

20 Claims, 9 Drawing Figures

Microfiche Appendix Included
(1 Microfiche, 7 Pages)

MOVING VISUAL DISPLAY APPARATUS

An appendix to this application includes a program listing in microfiche form for one embodiment. This fiche consist of 1 fiche and 7 frames.

BACKGROUND OF THE PRESENT INVENTION

The present invention relates to a moving display apparatus and particularly to a cyclically moving member having a plurality of light arrays, each of which includes a multiplicity of the light elements for selective energization to generate an elongated visual display.

In display systems, a visual display with means to control and change the displayed characters and message is often required or advantageous. A rotating or oscillating member carrying an array of light sources, with controlled energization of the sources permits generation of a display in space. For example, U.S. Pat. No. 3,744,048 discloses a rotating display member coupled to a planar display panel by a series of fiber optic lines. The panel member includes a plurality of rows and columns in a conventional rectangular coordinate array. Each of the display elements is coupled by a fiber optic line as a line coupling column to a rotating drum having a column of lights on the periphery. As the drum rotates, the line of light sources sequentially couples lights to the column by column array. By selective energization of the light sources with the drum rotating, various alphanumeric characters are generated on the planar display. The drum itself includes a single column of light sources formed by a plurality of aligned light emitting diodes. The diodes are connected to a source of energization through a plurality of slip-ring commutating couplers having a series of connection rings to provide selective energization of each element in the line of LEDs. The timing and number of lights illuminated is at a rate sufficient to minimize flicker. Thus, the patent suggests rotating at the rate of 3600 revolutions per minute or 60 revolutions a second. A generally similar system is shown in U.S. Pat. No. 3,958,235 in which an oscillating line of lamps is used in combination with lead control means to energize the lamps in combinations and particular locations within each scan cycle. The older U.S. Pat. No. 2,146,944 also discloses an advertising sign incorporating a series of linearly aligned tube segments or sections each of which contain a rare gas. Subjecting of a segment to a high electrical potential results in incandesence. The segments are coupled to a high potential source through a bus type connection and a commutating device for selective energization and illumination of the segments. Rapid rotation of the arm with the interconncted sections results in illumination of the appropriate sections to form an image of a letter or character in the space traversed by such sections. The commutating section includes the character to be displayed in combination with a matrix to scan such array and provide for corresponding illumination of the segments in synchronism with the location. Other light generating display systems are shown in U.S. Pat. Nos. 3,846,784 and 2,633,297.

Although various systems have been suggested, the complexities in the overall control and physical construction of the apparatus as well as in the interrelated electrical message controls present various practical problems. The prior art devices are not particularly adapted to providing a display in multiple color, or to convenient changes in the display. Further, the prior art devices are not particularly adapted to actuation of a moving display. Thus, it is often desired to have a message which is longer than the display area The message is preferably formed by scrolling across the display area. In such application, the message may be changed from time to time. To the best of inventor's knowledge, none of the prior art devices have found commercial implementation or construction.

There is a need for a display apparatus which can provide a scrolling type display in combination with means for controlling the presentation of the characters in the display in a simple, reliable and relatively economic construction. The display apparatus preferably is constructed to permit presentation in color, with means to change the color as well as the message in a simple and reliable manner.

SUMMARY OF THE PRESENT INVENTION

The present invention is particularly directed to a scrolling type display apparatus including a display generating means having lighting means in a given lighting array in combination with a logic and power control unit coupled to and moving with the display means in a cyclically and repetitive manner over a display space such that the power connection to the control unit provides the power for selective control of the lighting array and formation of a visual display. In another aspect of the invention, the display apparatus includes a plurality of the multiple light display generating means connected to a common moving support, such as a rotating support, in combination with the logic and power unit, such as a microprocessor, for controlling the display generating means for generating of the various alphanumeric and other characters in a visual display presentation and in programmed colors. In a particularly practical embodiment of the present invention, the display means includes a rotating drum member connected by a rotating support to a motor drive. The logic control and power unit is secured to the rotating support and includes a presettable logic control system such as a microprocessor for interconnecting of the lamps in the lighting array to incoming power in timed relation to the rotation of the drum. Where an external power supply is provided, a single set of incoming power leads is coupled through a suitable rotating coupling means to provide the logic power to the rotating control unit and the drive power to the individual light sources. The light sources are selectively energized in timed relation and in synchronism with the different angular orientation of the support drum to thereby present a series of closely spaced illuminated lines and points in space which generate a visually readable display or presentation. Thus, the message is defined by a matrix including a series of vertical column on the display space and each column including rows corresponding to the number of light means in each columnar light bank. In a particularly practical embodiment of the present invention, a plurality of lighting arrays are provided such as three parallel columns or banks of light sources, each bank being assigned and forming a basic color such as the basic colors of red, green and amber. The columns or banks are spaced from each other generally in accordance with time spaced angular division of the message matrix. Appropriate color control of the message is produced by successive illumination of the appropriate columnar banks at the same message location in the display frame.

More particularly, in a practical embodiment of the present invention the display support consists of an annular drum having an upper and bottom wall. The bottom wall includes a mounting bracket secured to a coupling member on the output shaft of a suitable drive motor, such as a suitable D.C. motor, a synchronized A.C. motor or the like. The periphery of the drum is thus located on a plane parallel to the axis of rotation and defines a message frame. Although one member of light arrays may be used, in a practical embodiment of the invention three light columns are secured to the periphery of the drum for viewing from the exterior of the drum. Each light column consists of a plurality of individual lamps. The drum is secured to the coupling member for rotating support on the motor shaft. A logic and power circuit board is affixed to the rotating support, and includes a single set of input terminals connected to a rotary power supply coupler. The on-board circuit board includes a logic system, preferably in the form of a microprocessor, which controls illumination of the individual lamps in each column. The microprocessor on the rotating support is preferably specially constructed to permit convenient change of the message program such as by use of plug-in memory board or integrated circuit (IC) unit, an erasable programmable read only memory chip or the like for establishing the particular character presentation to be created by the programmed illumination of the several individual lamps. The logic control includes a synchronizing means to lock the operation and the sequencing of the control into synchronism with the rotation of the drum. Each of the light banks may consist of a matrix of nine LED units hardwired to the power supply in series with solid state switches, such as switching transistors. The microprocessor includes suitable drive means connected to the solid state switch to effect the illumination of programmed combinations of the LED units at a proper position of each columnar bank in space.

During each revolution of the drum, a logic decision is made for each message column in the display frame. Each column is processed for determination as to whether illumination of one, two or all three of the respective columnar banks of lamps is to be superimposed and energized at the particular column. The display is divided into this series of closed spaced columns, and the display advances one column per revolution from a start position such that the message is progressively formed during each drum revolution to affect the scrolling type movement but at such a rate so as to appear as simultaneously generated in the display area. Further, the message frame or line on the drum spans slightly less than the total three hundred and sixty degree surface of the drum, with the start of the message and the end of the message in spaced relation as a result thereof. The message appears to disappear at the start line or column location and appears onto the drum from the end line or column location of the message frame. During each revolution, the logic circuit monitors not only the energization of the display columns but whether or not it is to be energized with a single color or a combination of the three colors. Conveniently, selection means for the several column drives are outputted each revolution with a color control means providing a color selection control to activate the columnar bank only when it produces the proper coloring of the display column being processed. The beginning and end frame columns are specially processed to prevent erroneous line formations. Such logic processing at high speed can be conveniently and fully executed using an on-board microprocessor. Thus, the invention is used uniquely and particularly adapted to use of a microprocessor unit.

Further, a plurality of spaced groups of display lamp banks may be used to energize each column more than once per revolution to minimize display flicker. Thus, the visual capacity of the eye requires the lighting of each space a predetermined number of times each second. Thus, the activation of each displayed column may be produced by increasing the speed of the movement of the bank of lights or the number of banks per cycle.

In accordance with a further concept and teaching of the present invention, the logic control unit can provide a timed energization of each lamp to produce a dot display presentation, or maintain energization until the next display column is processed to produce a streaking display presentation.

The present invention has been found to provide a display apparatus which produces an exceptional esthetically pleasing message or character presentation in a scrolling display format and in selective color. The display apparatus may be constructed with known technology and without the necessity of a complex construction. The present invention is therefore particularly adapted to commercial production and implementation.

DESCRIPTION OF THE DRAWING FIGURES

The drawings furnished herewith illustrate a preferred construction of the present invention in which the above advantages and features are clearly disclosed as well as others which will be readily understood from the following description.

DESCRIPTION OF THE ILLUSTRATED EMBODIMENT

Figure 2:
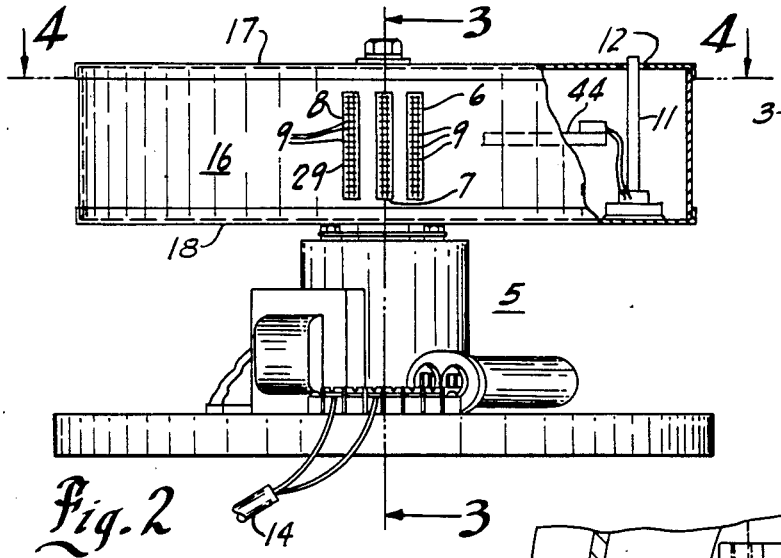
FIG. 2 is an enlarged side elevation view similar to FIG. 1 with parts broken away and sectioned to more clearly illustrate. details of construction.
Figure 1:
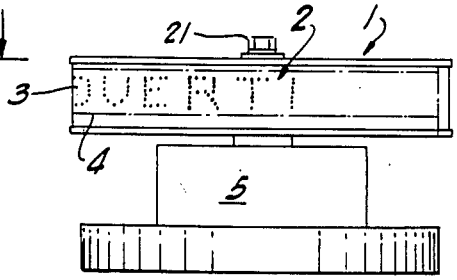
FIG. 1 is a side elevational view of a display apparatus incorporating the present invention.
Figure 5:
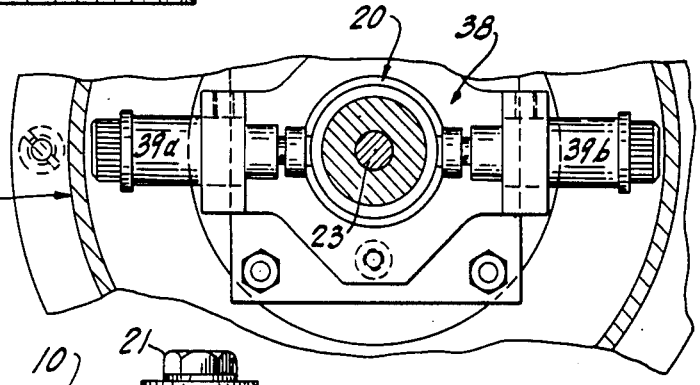
FIG. 5 is a horizontal section taken generally on line 5—5 of FIG. 2.

Referring to the drawings and particularly to FIG. 1, a rotating annular drum unit 1 is adapted to generate a message 2, apparently formed on the periphery of the drum unit. For purposes of illustration, a message such as "advertising will help sell" is to be generated, with the word "advertising" 3 shown on the drum unit 1 within an outer border 4 as the start of the message. A support and drive unit 5 is coupled to the drum and rotates the drum at a constant speed generally on the order of 1200 to 1800 revolutions per minute.

The message 2 is generated by a plurality of columnar light banks 6, 7 and 8 of light sources, which are secured to the periphery of the drum unit 1. The banks 6, 7 and 8 are oriented parallel to the axis of the drum unit 1. Each of the columnar banks is a vertical column of similar individual light sources 9 which are spaced to define a transverse row of light sources spaced as more fully developed hereinafter. The light sources 9 may be small individual lamps such as a light emitting diode, a high intensity lamp, electroluminescent panels, segments adaptd to be separately activated or other suitable means. For example, vacuum flourescent display (UFD) units are available with means for generating the three primary colors and with gate means for controlling the intensity of the color. The light intensity lamp produces white light which can be divided into the three primary colors. The advantage in using the three primary colors is producing the full color spectrum. Three LED banks 6, 7 and 8 of lamps 9 have been used and are shown to generate three different colors, one in each banks, such as red, amber and green. The message to be generated is divided into a series of equally spaced message or display columns and the lamps 9 in each bank 6–8 are aligned in rows, and are selectively energized in relationship to the rotational position of the drum unit and the lamp banks 6, 7 and 8 to illuminate the message columns, and thereby generating the corresponding aligned line portion of the message. In accordance with one unique aspect of the present invention, a logic control and power unit 10 is mounted within and to the rotating drum unit 1 and creates a self-contained on-board assembly which rotates with the drum unit 1. The output of the logic and power unit 10 is coupled directly to the individual lamps of the rotating columnar banks 6–8 and through programming of the logic unit 10 provides for selective display of particular messages. As more fully developed hereinafter, the logic portion of the logic and power unit 10 preferably incorporates a subsequently detailed microprocessor which includes a message memory IC unit 11 for programming of a given message 2. The message 2 may be conveniently changed by use of a removable plug-in chip or message board 11 which is accessible from the upper end of the rotating drum unit 1 through an opening 12 in the illustrated embodiment. With this system, an on-board battery supply may be used, or as shown, a single power supply connection is made through a suitable rotary coupling unit 13 to connect the logic and power unit 10 to an incoming power supply cable 14. The power unit 10 thus supplies both driving power to the lamps 9 in accordance with a predetermined logic system control in unit 10, which includes bank or banks 6–8 to be illuminated, and also which particular lights 9 within each bank are "on." Thus the message is defined by cartesian coordinate system of vertical columns aligned with the light banks 6–8, and horizontal rows aligned with lamps 9 which produces a matrix type character generation of an apparent message display generated on the drum wall. The message can be generated by lighting of the message characters, or with the proper background by a reverse lighting of the display frame around each of the characters.

The three columns or banks 6–8 each create a different color. By sequential superimposing of the light bank at any given column location in the apparent display surface, still different colors are generated in the display. For example, the message 3 may be displayed in one color or a combination of colors while the border 4 is in a different color. Any combination of colors which can be made by superimposing of the individual colors of banks 6, 7 and 8 can of course be generated within the message and/or frame.

More particularly in the illustrated embodiment of the invention, the display drum unit 1 is shown including an annular display skirt or wall 16 having an upper closure wall 17 and a bottom or base wall 18 secured to the vertically depending solid skirt. The top wall 17 of the drum 1 has a flange telescoped over the upper end of the skirt and is secured to a vertical coupling support 20 by a clamping bolt 21. The support 20 is a tubular member having a mounting flange 22 and is secured to drive shaft 23 of the motor 24. The drive shaft 23 and support 20 extends vertically from the drive motor 24 and the drive unit 5. The drive motor 24 may be any suitable D.C. or A.C. motor. An A.C. induction motor 24 has been satisfactorily used. The motor 24 is coupled to a main incoming power cable 14. However, a suitable D.C. permanent magnet motor may also be used. It is desirable to provide a reasonably constant speed drive, although as more fully developed hereinafter synchronism is provided within the logic unit to permit variation in the speed of drum rotation.

The periphery of wall 16 of the drum unit 1 is provided with three vertical openings 29, one for each of the light banks 6–8. As most clearly shown in FIGS. 3 and 4, each of the light banks consists of a support bracket 30 secured to the interior of the drum wall 16. Small LED lamps 9 or other suitable lamps are affixed to the bracket 30 and exposed through the aligned opening 29. A multiple lead ribbon cable 31 connects the individual lamps 9 to the logic and power unit 10. In the illustrated embodiment of the invention, each light bank 6–8 is formed with nine individual lamps 9. The lamps 9 are identically spaced in each of the banks. Each lamp 9 is connected to a power supply connector 32 on the unit 10, with the positive side connected to the incoming power cable 14 from the rotary coupling 13 and the negative connected to the negative of cable 14 in series with power driving, as more fully developed hereinafter.

Figure 3:
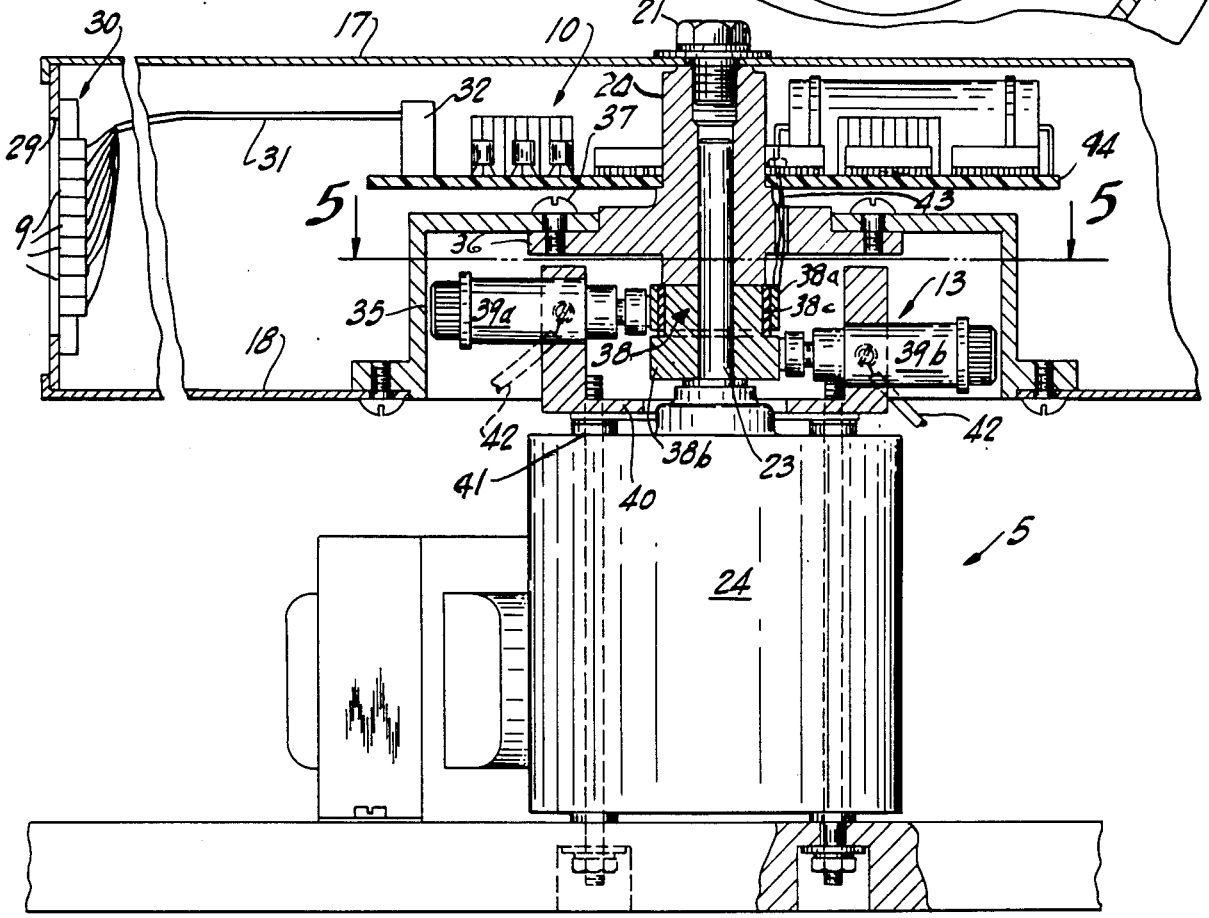
FIG. 3 is a fragmentary vertical section of the drum structure shown in FIG. 1 with the drive housing removed to illustrate certain drive components.
Figure 4:
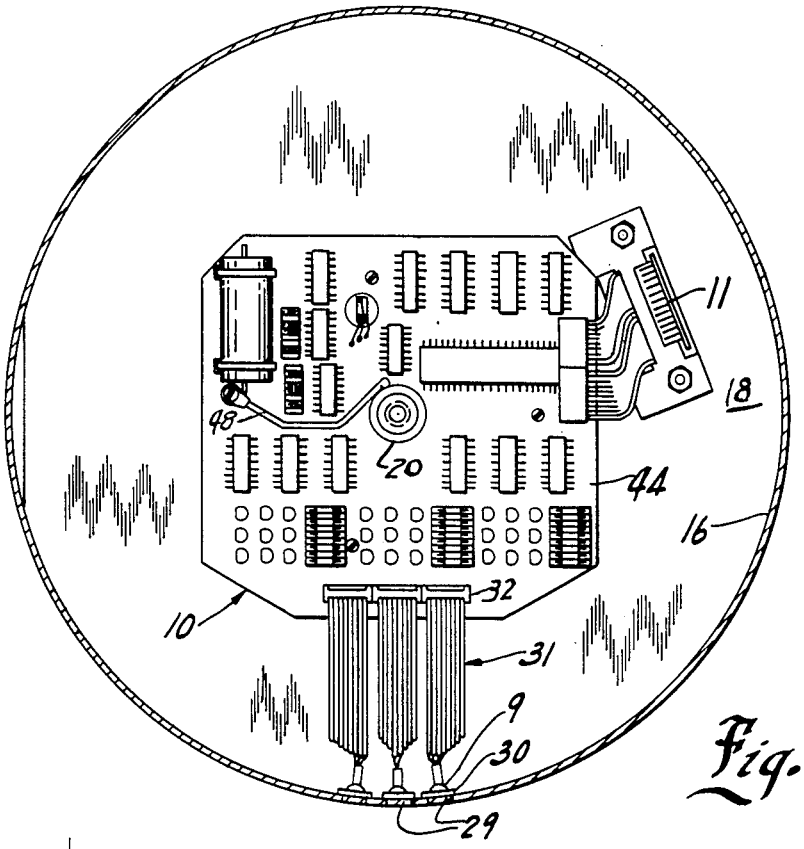
FIG. 4 is a horizontal section taken generally on line 4—4 of FIG.
Figure 6:
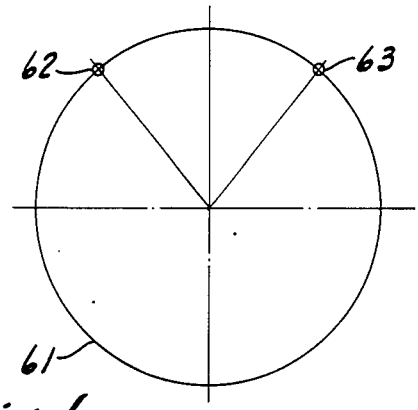
FIGS. 6 and 7 are diagrammatic illustrations of the drum display for simplicity of clearly illustrating and describing the display matrix and logic control systems used to generate a scrolling display in the illustrated embodiment of the present invention.

Referring particularly to FIG. 3, the drum bottom wall 18 has a central opening aligned with the motor 24 and the rotary power coupling unit 13. An inverted cup-shaped bracket 35 is secured to the drum wall 18 and projects upwardly through opening into the drum with the support projecting through the bracket. The coupling support includes a flange 36 overlapping the edge of bracket 35 and interconnected thereto by suitable connecting screws 37. The coupling shaft support 20 is telescoped downwardly over the motor shaft 23 and is keyed or otherwise affixed thereto to rotate therewith. The lower end of the coupling support 20 rests on the rotor assembly 38 of the rotary coupling unit 13 which is located within the cup-shaped bracket 35.

The rotary coupling unit 13 includes a pair of axially spaced and insulated rotors 38*a* and 38*b*. The rotor 38*b* is shown affixed to the mounting as a common ground which the rotor 38*a* is insulated by an insulator 38*c* and provides a positive power, thereby providing a negative and a positive power supply connection to the logic control and power unit 10. Similar brush units 39*a* and 39*b* are secured to the opposite side within the drum bracket 35 to the opposite sides of the rotors 38. A U-shaped mounting bracket 40 is secured to the motor frame 41 and extends projecting upwardly into the drum bracket. Each brush unit 39 and 39*b* is secured within one of the legs in alignment with the corresponding rotor 38*a* and 38*b*. A transformer-rectifier unit 42 has its output leads connected to the brushes 39 and 39*b* and its input connected to the cable 14. A cable 43 connects the positive rotor 38*a* to the circuit board. Although shown as a brush assembly, any other suitable means such as a rotary transformer assembly may of course be used.

The logic and power unit 10 includes a circuit board 44 secured to the flange 22 of the rotating coupling support 20 within the drum, and immediately beneath the releasable top or wall cover 17. The circuit board 44 projects outwardly and includes both the logic components, and a lamp power supply connection which are shown and described in detail in accordance with the schematic of FIG. 8. Generally, the output to the lamps 9 is from an output connector 32 secured to the periphery of the circuit board 44. The connecting tape cables 31 project outwardly from the connector 44 and are connected to the individual lamps 9 immediately adjacent to the lamp mounting bracket 30. The logic and power supply connection is made from an opposite side of the board 10 and includes a plug-in type connector to the rotor 38 of the rotary coupling unit.

The circuit board 44 otherwise consists of the various logic and power components as more fully shown and described in connection with the schematic circuit of FIG. 8. Although the logic system may have any desired form, the logic unit preferably includes a microprocessor system 46, and a preferred and satisfactory construction is shown.

Figure 8:
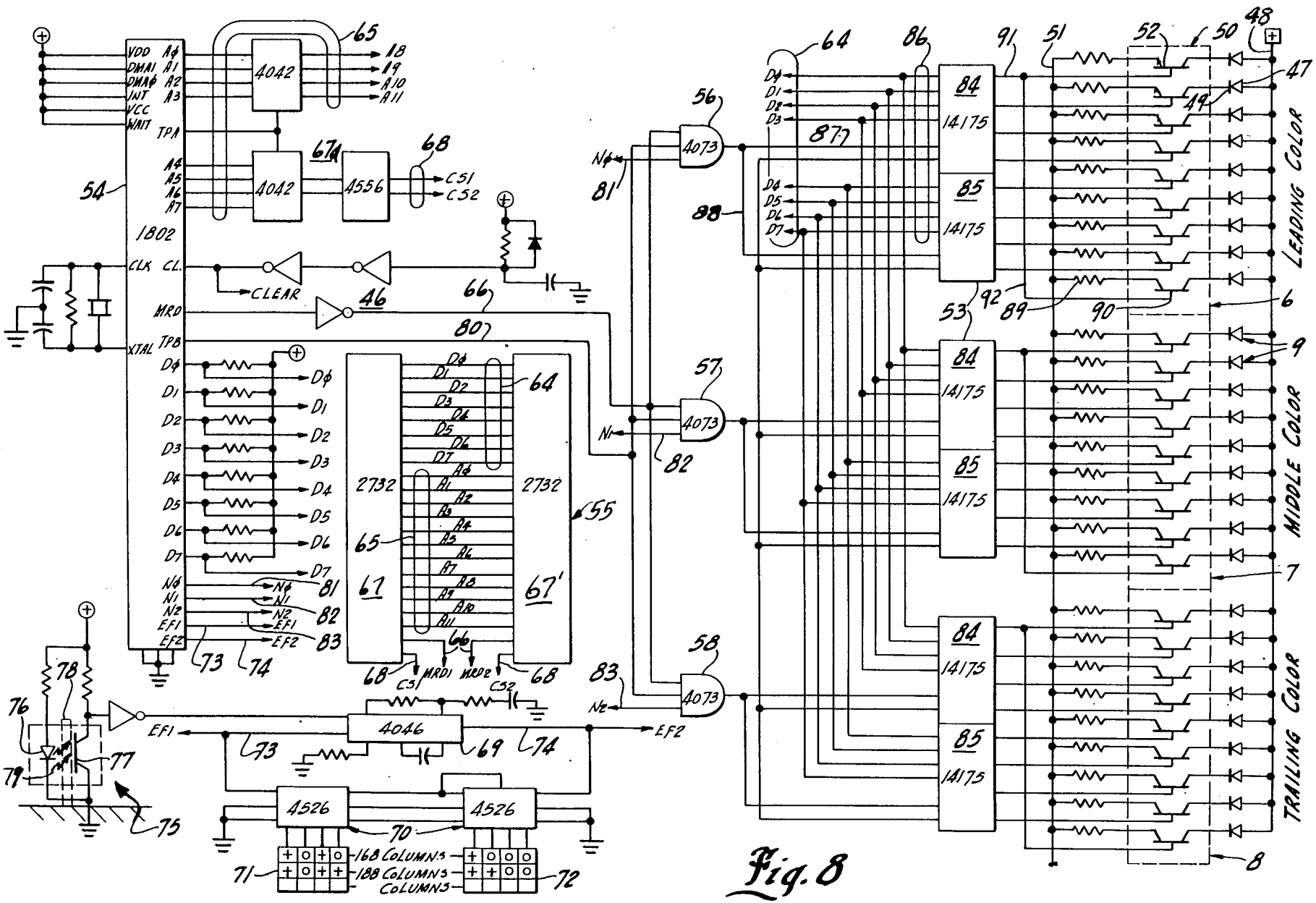
FIG. 8 is a schematic illustration of one on-board logic control incorporating a microprocessor.

Referring particularly to FIG. 8, the three lamp banks 6, 7 and 8 are shown schematically. Each lamp 9 is diagrammatically illustrated as an LED diode. The anode 47 of each LED unit is connected in common to a positive power supply lead 48 of the cable 31. Each connecting cable 31 for each light bank 6, 7 and 8 includes nine individual leads. The opposite side of each LED is individually connected through a power drive unit 50 to the negative cable lead 51 for selective energization of each lamp in accordance with a programmed sequence for generating of the particular display.

The power drive unit 50 is shown as a switching unit having a transistor 52 for each LED 9. Drive units 50 for the three banks 6, 7 and 8 are multiplexed from the microprocessor. The input of the individual transistors 52 for each bank 9 is multiplexed through a separate latch 53 from the data output of the microprocessor 54.

Figure 7:
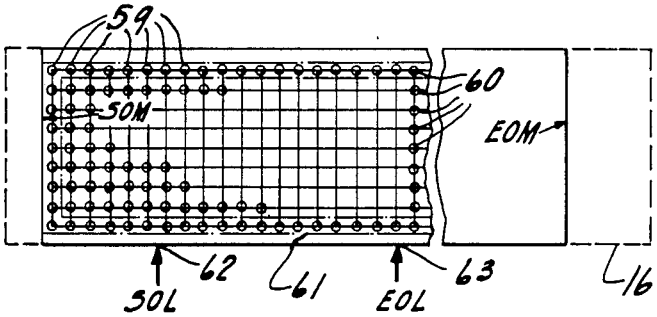

The microprocessor system 46 includes the microprocessor 54 which reads a memory system 55 of the IC unit II for program control and for controlling the transmission of data signals to the latches 53 for the several light banks 6, 7 and 8. Logic bank selection gates 56, 57 and 58 are connected one each to each of the latches 53 and the output of the processor 54 for selectively activating one of the three decoder latches and thereby activating a corresponding banks 6–8 in proper sequence and proper timing. As shown in FIG. 7 an expansion of the total message 2 is diagrammatically illustrated as an extended block 58, with a drum line or frame shown by phantom out line 61.

The message is defined as a program of close equally spaced vertical message columns 59 adapted to be successively illuminated by one or more of the light banks 6-8. The particular LEDs 9 in an energized light bank 6–8 of course determines the particular character displayed. The LEDs 9 thus provide matrix rows 60 which intersect the vertical columns 59 to form a message matrix identifying the location of LEDs 9 to be turned on. The data for each message column 59 is stored in the microprocessor memory 55 and particularly in the plug-in memory IC unit 11 in the illustrated embodiment of the invention. Because the message 2 may be longer than the display area or portion defined by the rotational surface generated by a rotating light bank, the message 2 is generated and displayed as scrolling message passing over the surface of the drum unit 1. As more fully developed hereafter, each scan of the drum defines a complete line or frame 61 of the message and the microprocessor system 46 is programmed to generate the several message lines in sequence to repeat the display of the message continuously. The total length of the message 2 may and often consists of a plurality of drum frames or lines 61 with a scrolling presentation of the total message 2. Thus, only the portion of the message equal to the drum display frame 61 is presented at any given time.

The total line or frame 61 between the start line 62 and the end line 63 is divided into the preselected number of equally spaced columns 59, such as 170 columns for each frame or line 61 and with selective illumination of the columns generating message characters. The columns 59 are sufficiently closed spaced to produce clearly readable characters in the message.

The message 2 scrolls from right to left across the face of the drum to permit reading of the total message 2. The visual message 2 is of course generated in the direction of rotation, beginning at the starting column location or line 62 of the drum and extending across the drum to the frame ending location column line 63.

During each drum revolution, one of the message columns 59 is removed at the start column location 62 and a new column is illuminated or activated and continuously added to the message adjacent the end portion of the display frame 61 at the end of frame column 63 to produce the scrolling display.

Microprocessor 46 is any one of the several machines available commercially and is only described in sufficient detail to clearly describe the invention. The memory unit 55 including the plug-in message section 11 and in accordance with known and conventional practice, a data bus 64 and an address bus 65 connect the processor 54 to memory 55. The address bus 65 allows selecting and reading the memory locations, while the data bus 64 allows for the actual transfer of information from memory. A control line 66 is provided for signalling memory unit 55 for reading the memory and transferring the data to the latches 53.

The illustrated memory array or unit 55 consists of a pair of similar memory units 67 and 67' such as known 2716 or 2732 IC units connected in common to the data bus 64 and the address bus 65.

The data bus 64 is also similarly connected to each of the latches 53 for the several light banks 6, 7 and 8. The illustrated processor 54 has eight direct address line 65 whereas the selected memory units require twelve addresses. A decoding section 67*a* is also connected to the eight address lines 65 of the processor 54 and provide for generation of the additional address lines for bus 65 for addressing of the memory 55. The decoder section 67*a* also generates a pair of memory unit selection lines 68 which are connected to the selection input of the two memory arrays 55.

The processor 54 is driven from timing means shown as including a phase locked loop having a pulse forming timing circuit 69 and a pair of divider circuits 70 which also include the necessary dividing inputs 71 and 72. The phase lock loop circuit 69 includes first and second timing output lines 73 and 74 connected to the processor 54. The timing signals activate the processor 54 in appropriate sequence and phase related rotation of the drum 1.

A drum phase detector 75 provides an input to the phase locked loop circuit and initiates a processing cycle once each revolution of the drum unit 1. The motor 24 may vary in RPM during the operation, and the processor cycle must start at the initial starting point or line in the drum rotation to maintain alignment of the lamp banks 6–8 with the proper message columns 59 in generation of the message 2. The detector 75 is shown as a photoelectric coupling unit to provide a synchronizing input to the phae lock loop circuit. More particularly, an LED 76 is connected in proximity with a phototransistor 77 to illuminate the transistor 77 during rotation of the drum 1. The photoelectric unit 75 is mounted in fixed relation to the rotating support fixture and the drum support 35. A fixed vane 78 passes between the LED 75 and the transistor 76 and thereby decouples the phototransistor 77 from the LED 76 once per revolution. Thus, each time the light beam 79 is broken, the transistor collector goes high and provides an input pulse to the phase locked loop. The unit 69 produces first and second outputs at lines 73 and 74 in timed relation to each revolution. The signal at line 73 is a single pulse in synchronism with the decoupling of the transistor 77 while the signal at line 74 is a pulse train equal to the number of message columns 59 formed on the display area of the drum. The signal at the first signal line 73 thus initiates a column processor cycle while the second signal at line 74 steps the processing cycle to generate the start signal and the column signals within each revolution for operating a light blank 6, 7 or 8 at the proper message columns 59 in the sequence as follows.

As the drum unit 1 passes through the start position 62, the processor 54 is signaled to start a bank activating cycle. The column pulse signals from line 74 synchronize the message column 59 alignment with the light banks 6–8. The processor 54 generates a timing signal at line 80 for enabling the light bank driving circuit.

The timing signal line 80 of the processor 54 is connected to the column light enabling gates 56, 57 and 58 for each of the bank latches 53 to establish multiple operation of the three banks 6–8. The processor 54 also includes the memory interlock signal line 66 coupled to the memory unit 55 and in common to a second input of the selection gates 56–58. The first two inputs enable all the gates for receiving a turn-on signal, for one gate at the appropriate time when data is to be transmitted to the latches 53.

The processor 54 includes a column strobe or selection line 81, 82 and 83 connected, respectively, one each to each of the GATES 56, 57 and 58. Each of the selection gates 56–58 is a conventional three-input AND gate having the three-input lines, each of which must be at a high logic signal level to enable that particular gate. Thus, one and only one of the gates is enabled at any given instance, and its output is connected to enable the one latch 53 for the corresponding light bank. Thus, any one color may be generated in the aligned message column. Thus, the program includes the data for selecting light bank to turn-on and the lights in that bank to turn-on.

Each of the latches 53 is similarly constructed and is shown consisting of a pair of 14175 IC latches 84 and 85. Data signal bus 64 connects the corresponding data output lines from the memory unit 55 to each of the three latch data inputs 86. The output lines of the gates 56–58 are connected to the latch strobe inputs 87 and 88 of the IC latches 84 and 85. The latch inputs are latched as a combination of signals to the several driver unit for the one light bank upon enabling of the one gate 56–58, and establishing simultaneous transmission of the combination of signals to the driver unit 50 for energizing the selective lamps 9 of the gated bank in the aligned column for appearance of the data information. The processor 54 thus latches in the color data into the individual latches 53 by sequential reading of proper memory locations and strobing the gates 56–58.

Thus, the nine LEDs 9 of the light banks 6, 7 and 8 are each interconnected between the positive power supply line 48 and the common ground return line 51 in series with a driver transistor 52 and a current limiting resistor 89. The transistors 52 are shown as NPN transistors having the collector-to-emitter junction connection in series between the resistor 89 and the LED 9. The base 90 of the transistor 52 is connected to a corresponding output line of the latch. Thus when the output line 91 from the latch 53 is high, it drives the transistor 52 on, thereby providing rapid turn-on of the associated LED 9. The processor 54 thereby provides controlled and selective energization of the LEDs 9 in the light bank 6.

In the illustrated embodiment of the invention, the uppermost lowermost LEDs 9 are connected in common by a jumper 92 to one output line 91 from the latch 53. This provides simultaneous energization of the two outer or end LEDs 9 and generates the top and bottom lines as the border 4 through the use of a single output line. Individual drives to each of the end LEDs would permit differing colors, if so desired.

The particular LEDs 9 which are energized is determined by the location of the light bank with the message column to be formed and the color to be generated at such location.

Further, each of the light banks 6–8 is constructed to generate a particular light strip of one primary or basic color. Thus, energizing of each light bank generates a different basic color, in which color the message may be directly presented, in whole or in part. If another color is desired, selective superpositioning of the light banks at a common display column generates various other colors.

The light banks 6, 7 and 8 are spaced from each other by a precise known mechanical displacement. The microprocessor system 46 provides appropriate signals to the system for energizing the light banks in superimposed timed spaced location. If the programmed color is one of the primary bank colors provided by light banks 6, 7 or 8, only that one light bank 6, 7 or 8 will be energized upon alignment of light bank with the appropriate column 59 location on the periphery of the drum wall 16 to form corresponding particular line portion of the message. For example, when the proper light bank is aligned with the vertical leg of the E, the number 2 through 8 LEDs 9 will be energized to form the vertical leg of the E. When the horizontal legs of the E are formed as proper light bank are successively and progressively aligned with three spaced portions and corresponding LEDs 9 will be energized by appropriate data input signals to the decoder 53 to generate the parallel lines or legs of the E.

The processor programming is shown in the flow diagrams or charts submitted herewith. The inventor further submits herewith for filing in the file wrapper, a program listing for operation of the display unit, generally in accordance with the above described flow diagrams. Programs are submitted for a "dot" pattern display and for a streaking display. The latter operates with the lamps maintained on for each column generation and until the next column is generated to provide a streaking effect to the message. As noted in the program listing, the start sequence as shown in the flow diagram includes the usual initializing of the system prior to actual execution of a program. In addition, in the illustrated embodiment of the invention, the speed of drum rotation is monitored to prevent start of program execution until a minimum drum speed is obtained. This is desirable to prevent adverse current to the lights as well as to insure a readable display and particularly one of pleasing appearance and without adverse flicker. For example, the pulse signal from line 73 is monitored and the pulse signals generated in a series of revolution must reach a selected level before program execution begins, as noted by the "start" instruction in the program listing. Thus, the minimum speed must exist for a plurality of revolutions before the program execution begins.

The program for the dot display is particularly described as it generates the functions disclosed in the basic flow chart for the microprocessor. In the illustrated embodiment of the invention, the message portion generated at any given time appears to be located on the drum wall 16 within a circumferential frame 61 between the start and end of line points or message columns 62 and 63, which is slightly less than 360 degrees of the total drum circumference. For example, the visual portion of the message 2 may cover 340 degrees between the start message line 62 and the end message line 63 on the drum, and include 170 display columns 59. Within this 20 degrees, the banks are not processed and permit idle display time during which the microprocessor may attend to housekeeping functions. When the processor receives a signal from the phase lock loop circuit line 73 for initiating a message portion, the processor 54 sets the start of line marker to the start of the message location in the program for deriving the first data for the first message column 59, at the start message column 62, as shown in the flow chart I at 100.

The column register or marker is then set to equal the start of line marker as at 101 to begin when the flag signal is received from the drum interlock means 77. The start of line marker is advanced for each complete revolution of the display light banks 6–8, particularly the leading bank, and in the illustrated embodiment is advanced one column 59. The advancement of the start of line marker each revolution results in the movement of the message from right to left, with the first column displayed at point 62 in the previous line or frame removed and a new column displayed at the terminal or column point 63. The program continues to cycle, moving the start of line marker each revolution and generating the message columns 59 which are to be displayed to produce the scrolling message. Each line or frame 61 consists of the 170 or other predetermined number of columns 59 within the length of the display portion 61 of the drum 1, and each frame is processed as shown in the flow chart.

In the multiple light bank system, the program is started with the start of the line register pointing to the first or A-color light bank 6. Further, with the lamp banks 6–8 separated by three message columns, column line controls such as registers, not shown, are preset for the second and third light banks 7 and 8 to record a corresponding column displacement count of two message columns, which are sequenced to energize the columns in successive program cycles.

As previously noted, the flag signal 73 from the phase lock-loop unit 69 to the processor 54 establishes the beginning signal in relationship to the passing of the start point or column 61 through the given space location. The processor 54 then waits for a column signal from line 74, which produces time spaced signals, one for each column in a drum rotation, as shown at 102. When each column signal is generated, the processor 54 enables the gates 56–58 in rapid succession and via the selection lines 81–83 sequentially reads the data in memory and outputs the data via lines 64, to the latches 53 to activate proper lamps 9 of the light banks 6–8, as noted at 103. As shown at 104, a delay is introduced in the program after which the light banks are blanked to produce a dot-type presentation. In the dot display, the LED on-time for each energization is held by a suitable timing control. The system may use an inherent delay in the processing cycle and/or may actually program in the delay. In the illustrated embodiment of the invention, the control is related to a given number of instructions. For example, in the program listing, eighteen instruction times define the LED on-time and the energizing of the LEDs. This is shown in the program by a corresponding number of normal operative instructions and where a sufficient number is not available, idle timing instructions are introduced into the program, as noted by the mnenonic NOP.

Each drum frame 61, as previously discussed, consists of 170 columns. The processor 54 monitors the column marker to determine if the "N" th or 170th column has been processed, as at 105. If not, the frame 61 has not been completed and the program advances the column marker one message column, and then checks to insure that the end of the message has not been reached, as at 106. If not, the program recycles as shown by line 107, to the wait for start column signal from the phase-lock loop signal line 74, indicating the proper position of the drum units to align banks 6–8 and again activate the next column, and then proceeding through the just described cycle. Thus, the light banks 6–8 will have moved one message column 59 on the display frame 61 and the appropriate memory locations in the message memory have been read and set in the latches 53 by sequential strobing of gates 56–58 to energize the appropriate lamps 9 of banks 6–8.

If the above last described column advance had moved past the end of message marker, the processor 54 at the decision step 106 would again set the advanced column marker to the start of the message as at 108, and recycle to restart formation of the message from the beginning.

When the program has cycled through all 170 display columns, the decision at step 105 branches to again initiate the proper recycling beginning at the frame start location 62 via line 109. The processor 54 then advances the start of line marker one column to advance and scroll the message frame 61 one column, as shown at 110, and then sequenced to determine whether the advancement has moved past the end of message at 111. If so, the program recycles to the start step 100 to start a repeat of the message, If not, the program recycles to step 101 setting the column marker equal to the start of line marker and continuing generation of the message by processing of new frame or line 61.

The illustrated embodiment with the three light banks 6–8 provide for superposing of the colors on any one column 59 for generating a plurality of additional colors. If a combination color is to be generated in a particular message column 59, that column is energized in sequential alignment by the proper light banks 6–8, starting with bank 6 followed by banks 7 and/or 8.

Flow chart II is similar to Chart I but expanded to illustrate the program sequence to create the proper activation of the light banks 6–8 at the beginning and at the end of each message, columns 62–63 at the opposite ends of the frame 61. The corresponding steps in the two charts are similarly numbered for simplicity and clarity of description.

In the three-color system, light banks 6–8 are mechanically offset by a fixed distance related to the column matrix distance, which may conveniently be three columns, such that the banks 6–8 are simultaneously aligned with three message columns 59 as they move between locations 62 and 63. By sequential activation of the several banks, a controlled superpositioning of the columns is created to thereby generate the desired combination of colors. The memory is bit mapped and each message column is assigned with three data location, one for each color bank. At each column alignment, the appropriate data location for the particular bank is read and the data sequentially placed on the data bus 64.

In the illustrated system, the light bank to be displayed is determined by presetting two registers, not shown, which the processor monitors at 115 and 119 of the Flow Chart. As shown in Chart II, during the processing each register is monitored at the beginning line or column location 62 and at the end line or column location 63 to determine which colors should be displayed. Thus, referring to Flow Chart II, when the program reaches the stage to actuate a light bank, a first comparison is made, as at 115, to determine whether the count of the number of times color bank 6 has been actuated and is equal to zero when bank 6 has been enabled three times. If not equal to zero, that indicates that color banks 7 and 8 cannot be properly displayed because neither light bank is aligned with a message column 59. The program steps directly to enable output of the first color bank 6. Simultaneously, the first register count is decremented by one. The color of bank 6 is outputted, as at 116, by operation of the appropriate drives to generate light dots at the appropriate rows of the first or starting message column 62 of the frame 59, as described with respect to Chart I.

At this point in the program a "Fix" program 118 can be introduced into the system to ensure the setting of all pointers at the necessary position. The "Fix" program is shown in Flow Chart III.

The processor, as previously described, then cycles to process the succeeding column. The count of the first register is equal to one at the second column and again indicates that banks 7 and 8 cannot be displayed and only the first bank 6 can be enabled. The processor 54 therefore repeats the above cycle with bank 6 aligned with message column 2 of the frame 61. This continues until the first register count is zero. When the register count is zero, the program steps to determine whether the third color bank 8 should also be enabled for display, as at 119.

The color bank 8 cannot of course be displayed until an additional three cycles. The comparison 119 so indicates and the second register count is decremented as at 120 and the program steps to directly bypass the bank 8, which is still the message columns removed from the first message column 62 of the frame 61, and enable the circuit for banks 6 and 7, at 121 and 116. The memory has been read the data latched in the latches 53 for bank 6 at message column 3 and for bank 7 at message column 1, and if appropriate sequentially strobed to light lamps of bank 6 and/or bank 7. The next sequences are the same as that just described until the decrementing of the second register count is equal to zero, indicating that the third color bank now may be enabled for display on the next cycle. Therefore, the processor 54 on the next column cycle sets the output to the color output drive for the bank 8 as at 123 to enable banks 6, 7 and 8, and sequentially strobes the banks 6–8 and activate the appropriate lamps, if any, of each bank. After the movement of all banks into alignment with the first frame column 62, the three banks 6, 7 and 8 are all enabled each column cycle until the color bank 6 has been processed through the end frame column 63.

When the program cycle determines the end column on the drum frame 61 has been processed, the first register counts are preset to a count of three, as at 124. An endline routine is then cycled to control the enabling and activation of banks 7 and 8 as at branches 125 and 126. When the bank 8 has been processed through the end frame column 63, the program recycles to initiate a new frame 61 and/or the start of a repeat of the message.

By operation of the system in the range of 1200 to 1800 RPM or greater, the message frame presented is visually stable, with only a very minimum and effectively non-detectable flicker. The results are particularly satisfactory because of accurate and precise timing and activation of the several light banks 6–8 in relationship to the display columns which can be produced by the rotating program and display assembly as an integrated unitary structure. Further, as previously noted, additional banks of lights, such as groups placed at 180 degrees to the illustrated bank may further reduce flicker in the presence of high ambient light and/or increase the intensity and the like.

The program thus continues to cycle through the generation of frames, with each completion of "N" columns advancing the start of line marker one column, which is compared to the column number to determine whether or not the start of the line marker is past the last and therefore the end of the message column; that is, in the given example, past column 2499. If it is not the program, recycles setting the column marker and the start of line marker together and recycling through the new frame which in effect produces a continuation of the scrolling message.

If the start of line marker has moved past the end of the message column, thereby noting the completion of the message, the start of line marker is reset to the start of message column position. The program again recycles from the beginning instruction to generate and repeat the message through the same sequence and cycle. The message may of course be completed in the center or some intermediate portion of the drum unit 1. The program of course starts repeating message on the remaining portion or frame 61 of the drum. The complete message is thereby continuously and repetitively generated as a scrolling message to the viewer. The several message columns are thus sequentially activated at the necessary rate to generate the scrolling message which appears to fold into the beginning location 62 and move out of the ending location 63 on the periphery of the drum 1. The color combination is readily controlled by appropriate programming of the plurality of light banks as the result of the superimposed alignment during successive cycles or revolutions of the drum.

The "Fix" sequence, as shown in Flow Chart III, is primarily active during the end of the message to determine whether or not any of the current color light banks are past the end of the message, and if so, the column marker are reset for that color to the start of the message.

In summary, the illustrated display unit is programmed to activate one frame per revolution beginning with the message column aligned with the start of line or frame line 62 on the drum and proceeding through the successive 170 frame columns, and with the frames shifted one message column for each revolution. The location of each light bank is monitored and with the light bank aligned with a message column, the light bank is activated to illuminate the appropriate rows.

The direct hardwired cable interconnection of the lamps and lamp control provided by the rotation of the logic and power supply unit with the lamps permits simple and reliable circuit connection and thereby minimizes the expense while improving the reliability. The total logic array and power unit mounted within the rotating support maintains a highly reliable and accurate physical construction thereby contributing to the simplicity and reliability of the system. Although shown with an external power supply the unit can of course be readily driven from an internal battery power supply mounted as a part of the rotating unit.

There is of course no limit to the length of the message, other than memory size, and the message can be readily changed by merely inserting of a new message module. The matrix approach used in the present invention permits the complete arbitrary design of the characters by permitting completely arbitrary energization of the lamps in each bank.

The viewing window or opening may be covered with a suitable paper or translucent screen to diffuse the dot presentation, if desired.

Figure 9:
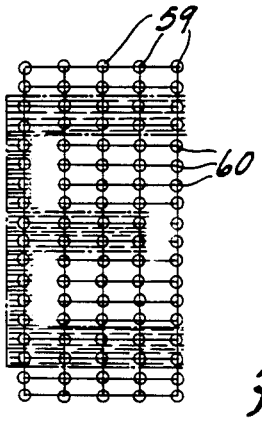
FIG. 9 depicts a displayed image.

A streaking display may be similarly generated in which the various individual characters of the message are generated as by interconnected segments rather than by the descrete segments produced by a dot type display. Thus, in such an embodiment, the inventor has used a pair of small series-connected LEDs for each row in each column. In the programming, as shown in the submitted program listing, the small LEDs are energized to effect a complete streak across each display location, generating rows in successive adjacent columns energized, a continuous line-type display is generated, such as shown in FIG. 9. The sequencing and cycling is essentially as disclosed in the dot presentation, except for the elimination of the column blanket step.

Further, although shown in connection with a display drum, the present invention is readily adapted to other forms of cyclically moving members. Thus, a flat light support can be rotated or reciprocated in a common plane to form a disc-like presentation of a message or other presentation. Further, the light means can be mounted to linearly reciprocate or move, thereby permitting generation of messages in a corresponding display space. These and other similar modifications to the present invention will be readily apparent to those skilled in the art based on the teaching and disclosure presented herein.

Further, in the illustrated embodiment of the invention, the message to be generated is carried by a separate plug-in memory board which is releasably maintained in the on-board connector mounted within the rotating drum. An erasable programmable memory may be used with any suitable remote coupling. For example, a message memory section may be provided having infrared coupling system. In such a system, a separate keyboard would couple infrared signals for serial inputting of data to the memory cells to encode the memory unit in accordance with the desired message. Thus, the structure of the illustrated embodiment of the invention with the on-board control may be varied many ways to provide a scrolling message space in accordance with the teaching of the present invention.

Further, the number of individual lamps in the display unit may be increased to increase the resolution, which particularly desirable for animation and complex graphic. Further, if the lamps are appropriately selected to project distinct light a small mass rotating light means may be projected into a larger fixed display member of a translucent or lenticular material.

Although a simple arm member carrying the lamps may of course be used to permit a visual display in space, the background drum produces an esthetically pleasing display and protects the circuit board and interrelated components from the surrounding environment as well as minimizing the sound generated. Such may be of special significance for small visual display for use in an enclosure such as a room, business establishment, such as a tavern or the like.

The present invention thus provides a reliable and a highly practical method of generating a visual display, and particularly a scrolling type of display.

Various modes in carrying out the invention are contemplated as being within the scope of the following claims particularly pointing out and distinctly claiming the subject matter which is regarded as the invention.

I claim:

1. A visual message display apparatus for generating a visual message in space comprising, a rotating cylindrical drum having an outer peripheral essentially continuous display wall and having an axis of rotation, an array of individually energizable light sources secured to said light sources spaced in the direction of the axis of rotation of said drum to define a columnar light bank, each of said sources including an input adapted to individually activate said light sources, a logic control means, a power means, said logic control means and said power means being coupled to and rotating with said drum and including power supply output means connected to said logic control means and to said light soruces for energizing of said light sources, said logic control means including means for activating of the said light sources during each revolution of the drum to provide for sequential activation of the light bank during successive revolutions of said drum to thereby generate a visual message in space, said logic control means establishing a complete programmed control of the activation of and light sources, said means coupled to said drum to rotate said drum and said interconnected logic control means and said power means and said light sources simultaneously and in predetermined fixed relation.

2. The visual display apparatus of claim 1 wherein said drum includes end closure walls secured to the drum in axially spaced relation and a central bearing unit secured to said walk to rotate the drum, an intermediate support wall secured to said bearing unit within said drum, said logic control and said power means being mounted within said drum and rotating therewith.

3. The visual display apparatus of claim 1 wherein said logic control means and said power means includes a microprocessor having control memory for controlling the enabling of said light banks in time spaced sequence and a program memory for controlling the light sources to be energized and thereby the message to be displayed.

4. The visual display apparatus of claim 3 wherein said light source secured to the wall, including a support plate mounted within said drum and connected to said drum, said logic control means and said power means being mounted on said plate within said drum and rotating therewith.

5. The apparatus of claim 3 wherein said message control memory includes a separate display memory chip having a plug-in connector terminal, said logic control means and said power control means having a plug-in connector adapted to receive said memory chip whereby said message is changed by selection of a memory message chip.

6. The apparatus of claim 3 wherein said message control memory includes a separate erasable programmable memory whereby said message can be changed.

7. The apparatus of claim 3 wherein said array includes a plurality of banks of lights spaced in the direction of rotation, each bank including a plurality of correspondingly located arrays of lights whereby rotation results in the corresponding lights in each array sequentially moving to the corresponding location in space, and said microprocessor includes means to superimpose illumination of said lights at said locations to generate said message.

8. The visual display apparatus of claim 7 wherein said banks are constructed to produce different colors whereby said superimposing generates additional different colors.

9. The apparatus of claim 8 wherein each array has said light sources spaced in the direction of the axis of rotation to define a columnar light bank, said microprocessor activating each bank during each revolution of the support means when said light bank is aligned with a message column and during successive revolutions of said support means advancing the display one column to thereby generate a moving visual message in space.

10. The visual display apparatus of claim 9 wherein said arrays are located in accordance with a matrix of axial columns and circumferential rows, and said microprocessor advances said light banks one column for each revolution of the drum whereby a scrolling message is displayed.

11. The visual display apparatus of claim 9 where said arrays include lights on the outer ends of each bank connected to a common output for generating a border on said display.

12. A visual display apparatus for generating an apparent visual message in space defined by a matrix of vertical columns of light means, comprising a moving display member having height slightly greater than the height of the message to be displayed and a length to continuously encompass the display area, drive means, a support member secured to said drive means and connected to said display member for cyclically moving the same, a plurality of light banks secured in close spaced relation to the display member and each being an array of lights spaced in the direction normal to the member movement, and each light having an individual input for controlling of said corresponding light, a logic control and power unit affixed to the support member and moving therewith, said logic control and power unit including a microprocessor and a power connection means having an input connected to supply power to said microprocessor and to said light segment inputs, said microprocessor having a programmed driver unit for each of said light banks and energizing of said banks to develop a visual display.

13. The apparatus of claim 12 wherein said microprocessor including a message program defining the message to be generated and a fixed program for processing of said message information and including means for advancing said message at least one column during each cycle of the movement of the member.

14. The apparatus of claim 13 including position sensing means for sensing the movement of a predetermined portion of the member relative to the display area of said sensing means being connected to actuate said processor to initiate a light bank driving cycle at a particular member orientation and a series of signals during each cycle for sequencing the processor in timed relation to the alignment of the light banks and said display columns.

15. The apparatus of claim 13 wherein each of said light banks generates a different color and being spaced from each other in accordance with a whole number of message columns, said program means including means to sequentially monitor the light banks to be activated at the first column line in said display portion and in the final column line in said display portion for proper activation in sequence of said three light banks and activate all three banks between such end column positions with controlled energizations of the banks to produce the desired color presentation of the said message.

16. A visual display apparatus for generating an apparent visual message in space defined by a matrix of vertical columns of light, comprising an annular drum member having a depth slightly greater than the depth of the message to be displayed, a rotating drive means having an output shaft, a coupling member secured to said shaft, means connecting said drum to said coupling member, three light banks secured in close spaced relation to the periphery of the drum and each being an elongated light bank extending parallel to the axis of the drum, and each bank including a plurality of light segments having an individual input for controlling of said corresponding segment, a logic control and power unit mounted within said drum and rotating therewith, said logic control and power unit including a microprocessor and a power connection means having an input means connected having an input and connected to supply power to said logic control unit or to said microprocessor and to said light segment inputs, said microprocessor having a programmed driver unit for each of said light banks each of said driver units including a plurality of outputs for individually driving one or more of said light segments, the end light segments being interconnected to each other and to a common driver, said microprocessor including a program defining the message to be generated and a fixed program for processing of said message information and including means for energizing at least one predetermined column during each drum revolution, position sensing means for sensing the movement of a predetermined portion of the drum relative to a reference point of said motor, and connected to actuate said processor to initiate a light bank driving cycle and a series of signals during each revolution for sequencing the processor in timed relation to the alignment of the light banks and said display columns.

17. The apparatus of claim 16 wherein said display encompasses significntly less than the total periphery of the drum and includes a message starting column position at one peripherial point and an end of message display line at a spaced peripherial line, a phase lock loop circuit including a triggered input connected to said position sensing means, said phase lock loop circuit generating a start signal in timed spaced relation with the position of the drum in response to the signal from said position sensing means, said phase lock loop circuit generating a second pulse signal of a frequency corresponding to the display columns within said drum the angular displacement of the display portion of said drum, said signals being connected to activate the microprocessor to establish a line reading program including means to activate said columns in said display portion during each revolution of said drum.

18. The apparatus of claim 17 wherein each of said light banks generates a different color selected from the said light banks being circumferentially spaced from each other in accordance with a whole number of said message columns, said program means including means to sequentially monitor the light banks to be activated at the first column line in said display portion and in the final column line in said display portion for proper activation in sequence of said three light banks, second trailing of the first trailing light bank in synchronism with the alignment of the second light bank with the first line position and monitors the energization of the third of the second trailing light bank in synchronism with the second alignment with the starting line column and correspondingly monitors the activation of the light banks in timed column spacing at the end of the message portion and said program operating to activate all three banks in between such end column positions with controlled energizations of the banks to produce the desired color presentation of the said message.

19. The apparatus of claim 16 wherein said drum rotates in a first direction, said message scrolling across said drum in the opposite direction, said message being generated by successive timed spaced energization of the succeeding line columns beginning with the line column into which the message scrolls.

20. The visual display apparatus of claim 1 including means to monitor the speed of said rotating support means operable to limit said logic control unit to energize said light sources at a minimum speed.

* * * * *